US007946290B2

(12) United States Patent
Morgan et al.

(10) Patent No.: US 7,946,290 B2
(45) Date of Patent: May 24, 2011

(54) UNDERWATER EXHAUST SYSTEM AND METHOD

(75) Inventors: William B. Morgan, Santa Barbara, CA (US); Peter M. Ryan, Orcutt, CA (US); Connie L. Morgan, Santa Barbara, CA (US); Trent M. Schultz, Goleta, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 716 days.

(21) Appl. No.: 11/893,772

(22) Filed: Aug. 16, 2007

(65) Prior Publication Data

US 2008/0041451 A1 Feb. 21, 2008

Related U.S. Application Data

(60) Continuation of application No. 11/110,154, filed on Apr. 20, 2005, now Pat. No. 7,357,134, which is a division of application No. 10/830,823, filed on Apr. 22, 2004, now Pat. No. 6,983,746.

(51) Int. Cl.

| | |
|---|---|
| ***B63C 11/02*** | (2006.01) |
| ***B63C 11/16*** | (2006.01) |
| ***B63C 11/10*** | (2006.01) |
| ***A62B 18/08*** | (2006.01) |
| ***A62B 18/10*** | (2006.01) |
| ***A62B 7/04*** | (2006.01) |
| ***A62B 7/10*** | (2006.01) |
| ***F16K 21/04*** | (2006.01) |

(52) U.S. Cl. ..... 128/201.11; 128/204.26; 128/201.27; 128/201.12; 128/201.15; 128/201.28; 128/204.27; 128/206.19; 128/201.26; 405/186; 405/187; 137/529; 137/542

(58) Field of Classification Search ..... 128/204.26, 128/201.27, 201.11, 201.12, 201.15, 201.28, 128/204.27, 206.19, 201.26; 405/186, 187; 137/529, 542

See application file for complete search history.

(56) References Cited

U.S. PATENT DOCUMENTS

| | | | | |
|---|---|---|---|---|
| 3,101,732 | A * | 8/1963 | Dalla Valle | 128/204.26 |
| 4,467,797 | A | 8/1984 | Franke | |
| 4,655,212 | A | 4/1987 | Delphia | |
| 4,856,120 | A * | 8/1989 | Hart | 2/428 |
| 4,872,453 | A | 10/1989 | Christianson | |
| 4,877,022 | A | 10/1989 | Christianson | |
| 4,884,564 | A | 12/1989 | Lamont | |
| 5,251,618 | A | 10/1993 | Christianson | |
| 5,502,515 | A | 3/1996 | Sansalone | |
| 5,575,277 | A | 11/1996 | Lutz et al. | |
| 5,657,746 | A | 8/1997 | Christianson | |
| D391,284 | S | 2/1998 | Hermansen et al. | |
| 5,868,129 | A | 2/1999 | Christianson | |
| 6,119,685 | A | 9/2000 | Kawashima et al. | |
| 6,129,081 | A | 10/2000 | Wu | |
| 6,371,109 | B1 | 4/2002 | Taylor | |
| 6,516,797 | B2 | 2/2003 | Chen-Lieh | |

(Continued)

*Primary Examiner* — Patricia M Bianco
*Assistant Examiner* — Nihir Patel
(74) *Attorney, Agent, or Firm* — Cislo & Thomas, LLP

(57) ABSTRACT

An underwater exhaust system and method which includes an exhaust valve having a sealing edge, an exhaust outlet for exiting an exhaust gas, and a projection for directing water flow away from the exhaust valve. The exhaust valve includes a valve head and a valve stem, the valve stem being coupled with the valve head. The system and method prevent a siphoning effect, whereby leakage of water into the exhaust valve is minimized or prevented.

4 Claims, 8 Drawing Sheets

U.S. PATENT DOCUMENTS 6,953,247 B1 10/2005 Duffy et al.
6,983,746 B2 1/2006 Morgan et al.
D522,562 S 6/2006 Godoy
2006/0272637 A1 12/2006 Johnson

* cited by examiner

UNDERWATER EXHAUST SYSTEM AND METHOD

CROSS-REFERENCE TO RELATED APPLICATION(S)

This document is a continuation application which is related to, and claims priority through, U.S. patent application Ser. No. 11/110,154, also entitled "Underwater Exhaust System," filed Apr. 20, 2005, now U.S. Pat. No. 7,357,134 which is, in turn, a divisional application of U.S. patent application Ser. No. 10/830,823, entitled "Underwater Exhaust System," filed Apr. 22, 2004, now issued as U.S. Pat. No. 6,983,746, all documents of which are hereby, and herein, incorporated by reference in their entirety.

TECHNICAL FIELD

The present invention technically relates to equipment for scuba diving. More particularly, the present invention technically relates to systems for managing exhaust during scuba diving. Even more particularly, the present invention technically relates to systems having an improved exhaust valve for managing exhaust during scuba diving.

BACKGROUND ART

Many examples of underwater devices exist which have exhaust systems that expel the exhaust air or mixed gases into the surrounding water during their normal functions. One example of these related art systems is the Second Stage Regulator used for self-contained underwater breathing apparatus (SCUBA) divers.

Some SCUBA diving setups include a tank of compressed air or mixed gases that is worn by the diver, a first stage regulator attached to the tank that reduces the compressed air pressure form 3000 psi to around 150 psi, a hose that connects the first and second stage regulators, and a second stage regulator being held in the diver's mouth that reduces the pressure from 150 psi to ambient pressure and that supplies the air to the diver upon demand.

The SCUBA second stage regulator includes the following components: a regulator housing, a flexible diaphragm that collapses inwardly during the inhalation cycle against a small lever that activates an inhalation valve for supplying the diver with air, an exhaust valve which is used as a one way valve to allow the exhaust air or gases to escape the regulator housing during the exhalation cycle, a bubble deflector to guide the exhaust bubbles out of the way of the diver's vision, and a mouth piece to seal out the surrounding water and to hold the regulator assembly in the diver's mouth.

The exhaust air or gases exit the SCUBA second stage regulator travels through an opening in the wall of the regulator housing. An exhaust valve is mounted on the outside, covering this opening, and is used as a one-way valve to control the direction of flow of the exhaust gases. The circular opening has one or more cross bars that go from one side of the opening to the other side and are to be used as a mounting area for the exhaust valve and to help prevent the exhaust valve from collapsing inwardly when there is a negative pressure experienced.

Exhaust valves comprise a molded flexible rubber or silicone and are usually made in round disk or mushroom-type shape. They are designed to flex or peel away under pressure to open and close. The purpose of the exhaust valve is to control the direction of flow of the exhaust gases and to keep the surrounding water out of the regulator once the flow of gases has stopped.

Many of the SCUBA second stage regulators exhaust directly into the surrounding water without any backflow prevention features. This circumstance involves the water being in direct contact with the entire outside surface of the exhaust valve. Most of the second stage regulators also have the exhaust valve(s) mounted at an angle an in the low point within the regulator housing. This configuration helps to collect any water that has entered the regulator at or near the bottom of the system so that the water can be cleared or purged.

A few reasons exist for exhaust valves having water seepage, or leakage back, into the regulator. One reason is that a condition of "under-pressure" occurs during the inhalation cycle. This under-pressure causes an inward flexing of the exhaust valve, thereby distorting the valve against the edge of a circular opening and cross bars, and thereby the valve to leak. Another reason is that a water flow catches the outside sealing edge of the exhaust valve, thereby flexing the valve into an open position, and thereby causing the valve to leak.

Several reasons exist for water flowing outside the exhaust valve. One reason is that, when the diver enters the water somewhat rapidly, i.e., by either jumping or sliding, the water very quickly floods the open areas of a bubble deflector. Further, the water rushes into the valve by flowing around the outside surfaces of the exhaust valve. The water catches the edge of the valve, thereby flexing the valve, and thereby causing the valve to leak.

Another reason for water leaking around the exhaust valve is a laminar flow of water that is created by the exhaust bubbles. Once the exhaust gases travel through the circular opening and past the exhaust valve, the gases become, or create, bubbles. These bubbles are naturally buoyant and travel upward toward the surface of the water. As the bubbles are traveling upward, they affect the surrounding water in which they are in contact, thereby drawing the water upward as well, and thereby creating a laminar flow of water which flows on, and past, the exterior surfaces of the exhaust valve.

The related art exhaust valves have been designed to provide low exhaust resistance during heavy breathing rates. This circumstance has resulted in the related art valves becoming somewhat larger (1"-1.5" in diameter) or the systems having multiple or several valves. When the diver is breathing at a lower or moderate rate, only the upper portion of the exhaust valve is used while the lower portion remains in the closed position. The laminar flow of water created by the bubbles exiting the top portion of the valve catches on the lower sealing edge of the exhaust valve, thereby causing the valve to leak. Seepage or leakage of water via the exhaust valve is a nuisance, at best. However, a leakage condition can be a dangerous situation if diving is performed in contaminated or polluted water.

Another common feature of most of the SCUBA second stage regulators is a bubble deflector. The bubble deflector is made of a molded rubber or plastic and is mounted around, or adjacent, the exhaust valve(s). The purpose of the bubble deflector is to capture the exhaust bubbles and divert them away from the front of the diver's face to provide a good line of vision.

The related art bubble deflectors include bubble exit openings that are large enough to allow water to enter the lower half or lower portion of the bubble exit opening, while the bubbles escape from the top half or top portion of the bubble exit opening. The water entering at the lower half or lower portion of the bubble exit opening is part of the laminar flow of water that the bubbles create.

FIG. 1 shows a gas exhaust system for a SCUBA apparatus, in accordance with the related art. A related art exhaust valve covers the opening where gas exits the system. The exhaust valve is circular; and the path that the exhaust takes is shown by the directional arrow B. Water that is external to the system travels in a path following the directional arrow A. When gas exhausts from the system, it will do so at the top (or where pressure is the lowest), as indicated by the minus sign. The water will travel upward with the bubbles to create a laminar flow of water across the exterior of the exhaust valve. This laminar flow of water catches the lower sealing edge of the related art exhaust valve, thereby causing the valve to leak as experienced in the related art. Furthermore, water enters the system through the bottom of the related art exhaust valve due to the flow created. As such, a long-felt need exists for an underwater exhaust system in which leakage is at least minimized and preferably eliminated altogether.

DISCLOSURE OF THE INVENTION

Exemplary embodiments of the present invention, as herein disclosed, are generally directed to an underwater exhaust system which eliminates the foregoing leakage problems in the related art. In accordance with one aspect of the invention, an underwater exhaust system generally comprises a housing for an air regulator, an exhaust valve operatively coupled to the air regulator housing and having a water interface side with at least one sealing edge, and a valve cover operatively coupled to the exhaust valve and adapted to create an exhaust air pocket on the water interface side of the exhaust valve. The pocket allows at least one portion of the exhaust valve to operate in exhaust air medium during underwater use of the air regulator. The valve cover includes at least one water inlet passage and at least one exhaust gas opening.

In accordance with another aspect of the invention, an underwater exhaust system generally comprises a housing for an air regulator, an exhaust valve operatively coupled to the air regulator housing and having a water interface side with at least one sealing edge, and a valve cover operatively coupled to the exhaust valve and adapted to create an exhaled air pocket on the water interface side of the exhaust valve. The pocket allows at least one portion of the exhaust valve to operate in exhaled air medium during underwater use of the air regulator. The valve cover includes at least one water inlet passage and at least one exhaust gas opening. The underwater exhaust system also comprises a bubble deflector operatively coupled to the valve cover. The bubble deflector includes at least one water inlet passage. Other features of the present invention are disclosed, or are apparent, in the section entitled "Mode(s) for Carrying-Out the Invention," disclosed, infra, and in the accompanying Drawing.

BRIEF DESCRIPTION OF THE DRAWING

For better understanding of the present invention, reference is made to the below-referenced accompanying Drawing. Reference numbers refer to the same or equivalent parts of the present invention throughout the several figures of the Drawing.

MODE(S) FOR CARRYING-OUT THE INVENTION

Figure 1:
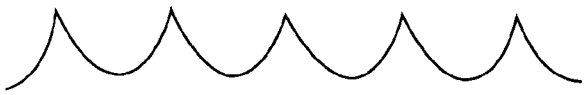
FIG. 1 (Prior Art)
FIG. 1 is a plan view of an underwater exhaust system, in accordance with the prior art.
Figure 1:
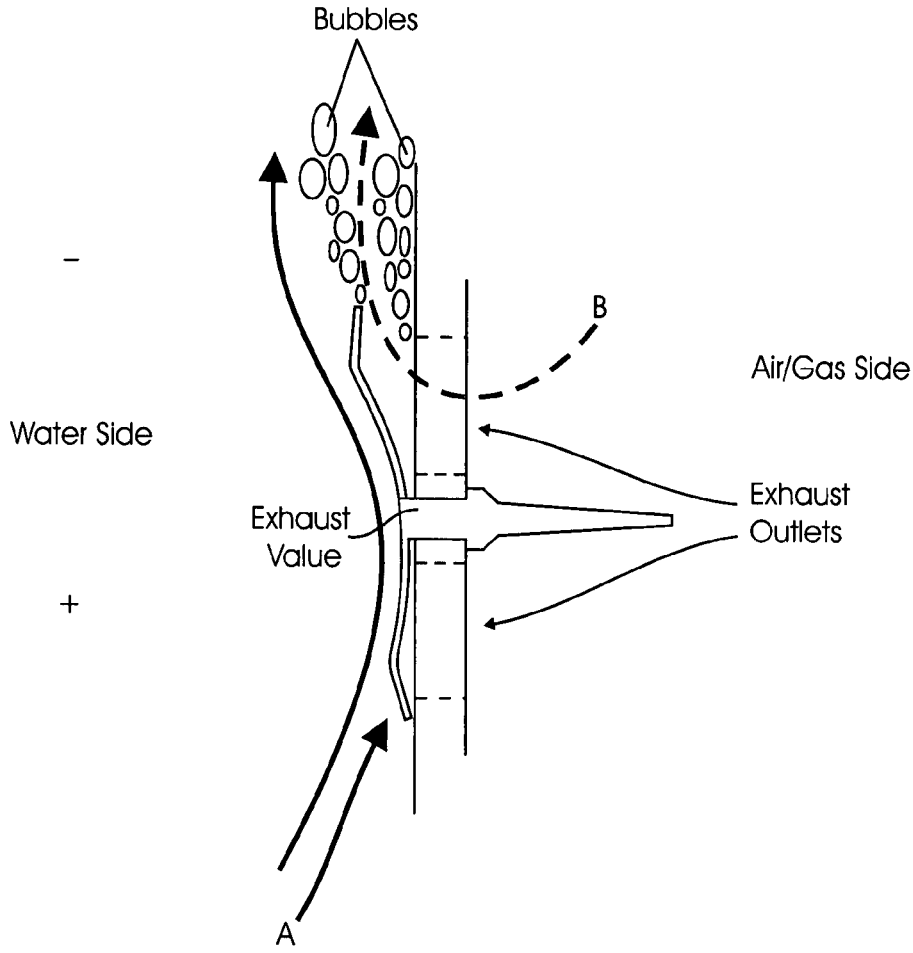
FIG. 1 (Prior Art)

Exemplary embodiments of the present invention, disclosed herein, are generally directed to an underwater air/mixed gas exhaust system that is installed or designed into a diving regulator that lowers the exhaust resistance by creating an air space on the outside/water side of the exhaust valve(s) within which at least the upper portion of the exhaust valve(s) operates during the most commonly used positions and by providing exhaust valve(s) with sealing edge protection and a laminar flow of water across the outside of the exhaust valve when needed to avoid a siphoning effect by the gases or a free flow condition of the gases.

One of the exemplary embodiments of the present invention is in the form of a bubble deflector that can be installed onto a SCUBA second stage regulator. This bubble deflector is manufactured and installed in a manner where it captures part of the exhaust air or gases in a hood or valve cover. The hood or valve cover allows an upside-down cup-type of air space to form within the bubble deflector, and creates an air space in which at least the top portion of the exhaust valve operates during the most commonly used positions by the diver (looking forward or downward at an angle of approximately 30° to approximately 45°).

To prevent any type of a free flow condition created by the exhaust gases (bubbles) traveling through the bubble deflector, a water inlet is configured in the bubble deflector directly below, and adjacent, the bottom of the exhaust valve, in accordance with the present invention. This water inlet passage allows water to flow inward and up from the bottom of the bubble deflector and creates a laminar flow of water that travels past the exhaust valve to combine with the exiting gases or bubbles which are traveling through, and from, the bubble exit openings in the bubble deflector. The continuous supply of water in the form of a laminar flow that travels past the exhaust valve prevents a siphoning effect by the exhaust gases/bubbles, which, otherwise, would cause a free flow condition of gases in the regulator.

According to exemplary embodiments, the water inlet passage is located at a lower point in the bubble deflector than that of the edge or lip of the hood that is used to create the air space in which the exhaust valve operates. Having the water inlet passage located below the lip of the hood and directly adjacent the bottom of the exhaust valve prevents any type of siphoning effect by the exhaust gases and allows the bubbles as well as the water to travel upward together in a desired direction within the bubble deflector.

The water inlet allows the ingress of water into the bubble deflector during normal use in the most common positions. Furthermore, the water inlet is also advantageous during less common positions, such as in an "upside down" position or in a "face up" position. In those positions, the bubbles naturally flow through, and out, the water inlet passage, because the water inlet passage of the present invention is then disposed at the highest exit point within the bubble deflector. Having the water and bubbles being able to reverse the flow through the water inlet passage in these positions minimizes the exhaust resistance in these positions.

Other exemplary embodiments of the present invention include an exhaust valve sealing edge protector. The protector "protects" the sealing edges of the exhaust valve from being caught by the laminar flow of water traveling past the outside surfaces of the exhaust valve, otherwise causing the valve to leak. This protector is an integral part of the bubble deflector or regulator housing, is in the form of a stepped/recessed exhaust valve seating area or a protector ring that is around, and is slightly larger in diameter and taller than the outer sealing edge of the exhaust valve(s).

Yet another exemplary embodiment of the present invention includes an exhaust valve cover. This valve cover is mounted in an airtight fashion around the exhaust valve and creates the air space in which the exhaust valve operates. This valve cover has two holes, an exhaust gas exit opening, and a water inlet passage.

The exhaust gas exit opening is located at a low point of the cover to create the air space in which the exhaust valve operates. The size of the exhaust gas exit opening is larger than the area of the circular opening (exhaust) in the regulator housing. This circumstance guarantees that the flow of exhaust gases, passing through the exhaust gas opening in the cover, will not be constricted in any way. The water inlet passage in the cover is located below, and directly adjacent, the bottom of the exhaust valve. This inlet passage is configured to allow water to flow inward and through the cover to prevent any siphoning effect by the exhaust gases, which, otherwise, would cause a free flow condition of the gases.

If a bubble deflector is used with the valve cover embodiment, a water inlet passage is provided in the bottom of the bubble deflector located below, and directly adjacent, the bottom of the exhaust gas opening of the valve cover. This water inlet prevents any type of siphoning effect on the exhaust gases traveling through the bubble deflector.

Figure 2:
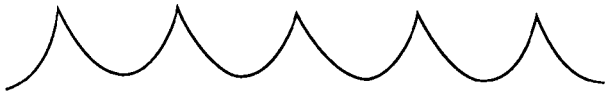
FIG. 2 is a plan view of an underwater exhaust system according to an exemplary embodiment of the present invention
Figure 2:
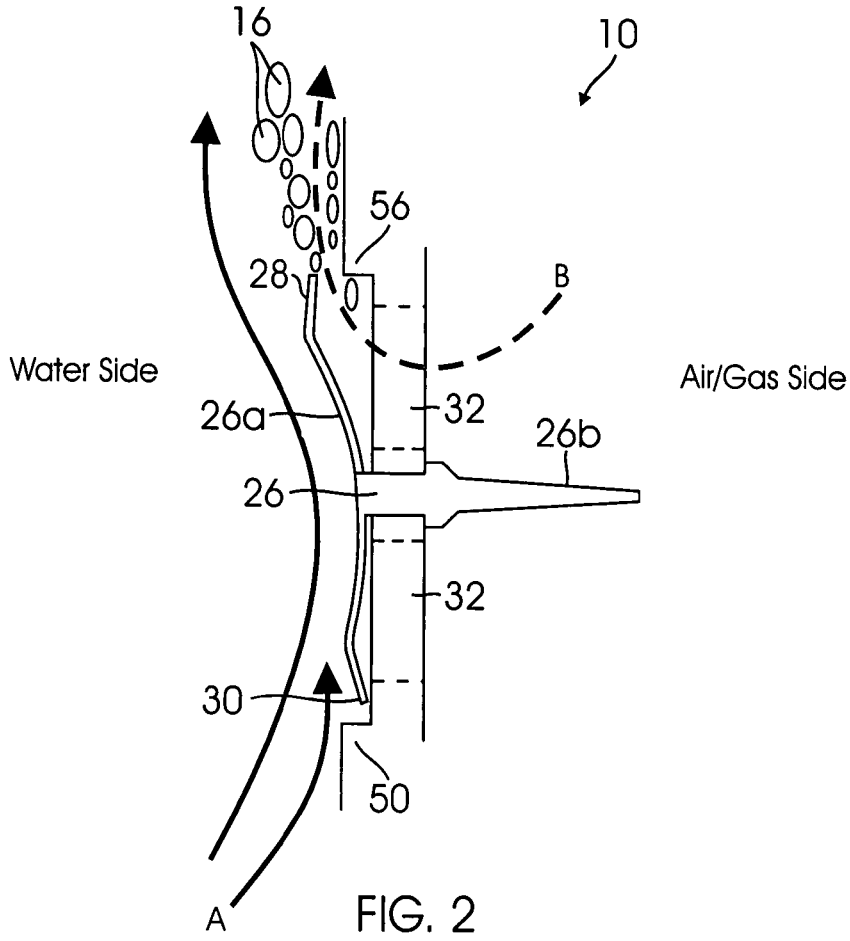

FIG. 2 shows an embodiment of a SCUBA system 10 according to an exemplary embodiment of the present invention. The system 10 includes an exhaust valve 26 and exhaust outlets 32. The exhaust valve 26 comprises a valve head 26*a* and a valve stem 26*b*, the valve stem 26*b* being coupled with the valve head 26*a*, the valve head 26*a* having a cross-sectional area, a water-interface side, and at least one sealing edge. In this embodiment, the housing comprises an exhaust gas outlet 32 having a cross-sectional area. The system 10 also comprises at least one projection for directing water flow away from the at least one sealing edge of the exhaust valve 26. The exhaust gas outlet cross-sectional area is less than the valve head cross-sectional area. Furthermore, the at least one sealing edge of the exhaust valve 26 comprises an upper sealing edge 28 and a lower sealing edge 30. Since the valve 26 is typically circular, the valve 26 will generally have an upper sealing edge 28 and lower sealing edge 30. That other configurations may be utilized, including, but not limited to, a configuration with either an upper sealing edge and/or a lower sealing edge, as desired, will be appreciated as being within the scope of the present invention. The gas is forced from the system 10 by pressure as shown by the directional arrow B. This condition causes the water to flow in a path as shown by the directional arrow A. The gas exits the system 10 as a plurality of bubbles 16.

The system 10 also includes an upper projection 50 that directs the flow of the water away from the lower sealing edge 30 of the exhaust valve 26, in accordance with the present invention. In this manner, the water flow is directed about the exhaust valve 26 such that water entering the system 10 is less likely, either via the lower sealing edge 30 or other portion of the exhaust valve 26. Furthermore, being circular, a lower projection 56 surrounds the edge of the valve 26. The lower projection 56 decreases the likelihood that water enters the system 10 via the upper sealing edge 28 of exhaust valve 26.

Figure 3:
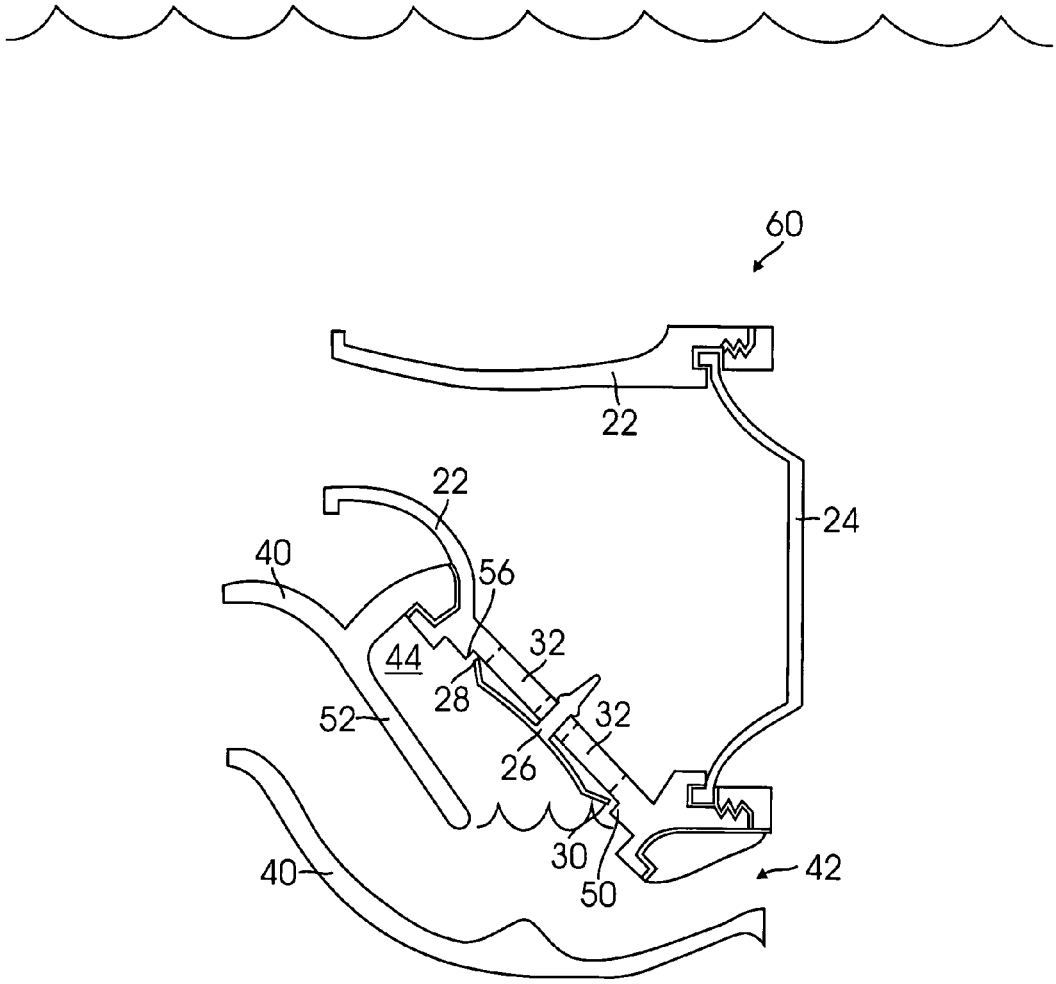
FIG. 3 is a plan view of an underwater exhaust system shown in the face forward position, according to another exemplary embodiment of the present invention.

FIG. 3 shows a gas exhaust system 60 for a SCUBA apparatus, in accordance with another embodiment of the present invention. The system 60 includes a regulator housing 22, a diaphragm 24, and an exhaust valve 26. In this embodiment, the exhaust valve 26 is circular and includes an upper sealing edge 28 and a lower sealing edge 30. The sealing edges 28, 30 are configured to allow gas to exit the system 60 via exhaust outlets 32. Shown in this "face forward" position, the entire exhaust valve 26 is operating in the gas pocket 44. This condition reduces the pressure on the outside of the valve 26 and makes the valve 26 easier to open and/or operate.

The system 60 also includes a bubble deflector 40, in accordance with the present invention. The bubble deflector 40 includes a hood 52 which allows a gas pocket 44 to form adjacent the exterior of the exhaust valve 26. This gas pocket 44 allows for less resistance in operating the exhaust valve 26, because the valve 26 is disposed in the gas pocket 44 rather than directly in contact with the water. Such configuration equalizes the pressure between the region interior of, and the region exterior of, the exhaust valve 26 such that a free flow condition of gas exiting the system 60 is less likely. As more gas exits the system 60, the gas will be forced out and around the hood 52 such that the gas will exit the system 60. Furthermore, the bubble deflector 40 is configured to exhaust the gas bubbles 16 away from the mask and/or visual area of the user. The flow of water that is allowed to enter via the water inlet hole 42 provides a laminar flow of water across the exhaust valve 26, thereby preventing a siphoning effect by the gases or a free flow condition of the gases.

The system 60 may, again, include projections 50, 56 to further direct the water about the exhaust valve 26, such that the water will less likely enter the system 60 via the exhaust valve 26, either between the upper sealing edge 28 or the lower sealing edge 30 of the circular valve projections 50, 56 or between the sealing edges 28, 30 and the valve seat (not shown). The projections 50, 56 create an exhaust valve sealing edge protector such that water does not directly flow toward the edge of the circular valve, e.g., a rubber valve, in a manner that would allow water to enter the system 60 via the sealing edges 28, 30 as otherwise would occur in the related art systems.

Figure 4:
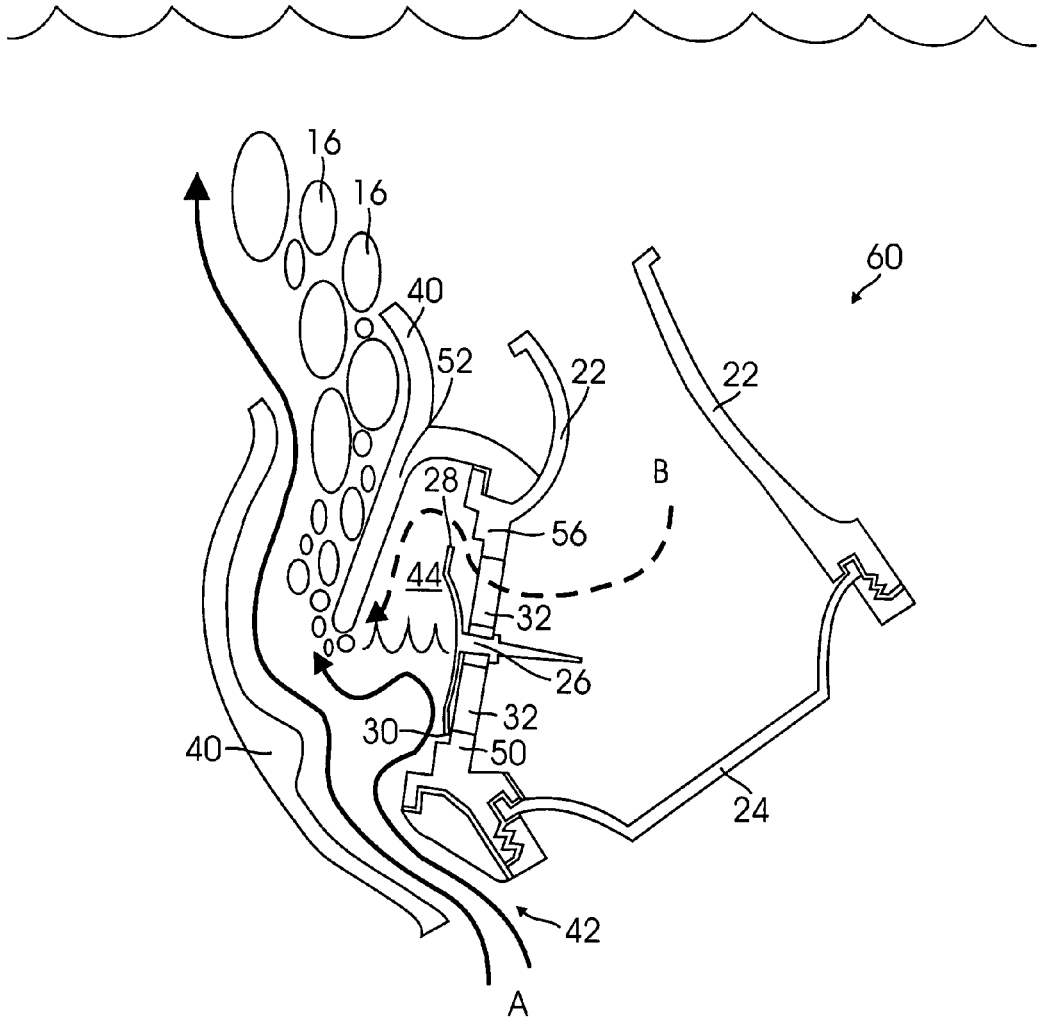
FIG. 4 is a plan view of the underwater exhaust system of the present invention, as shown in the embodiment of FIG. 3, illustrating the flow of water and exhaust air about the system in a face down position.

FIG. 4 shows a different orientation of the exhaust gas system 60, in accordance with the present invention. Again, the system 60 includes a regulator housing 22, a diaphragm 24, and an exhaust valve 26. Furthermore, the system 60, again, includes a bubble deflector 40 which includes a hood 52 for allowing a pocket 44 to be created by the gas exiting the system 60 as shown by the directional arrow B. The pressure created by the exiting gas forces open top sealing edge 28 of exhaust valve 26 as the gas exits the system 60 through the exhaust outlet 32.

Shown in another common position and with a downwardly perspective, the top half of the exhaust valve 26 is still able to operate in the gas pocket 44, thereby lowering the resistance. In this manner, the hood 52 allows an exiting gas pocket 44 to form which equalizes the pressure about the upper sealing edge 28 of the exhaust valve 26. This configuration reduces the likelihood of a free flow condition of gas exiting the system 60. Furthermore, this configuration facilitates the direction of water about the exhaust valve 26 such that water less likely enters the system 60 and such that a free flow condition of gas exiting the system 60 is less likely. A possible water flow in this embodiment, is shown by the directional arrow A.

As the gas exits the system 60, as shown by the directional arrow B, the gas builds up in the pocket 44 and will exit the system 60 as a plurality of bubbles 16 via the bubble deflector 40. With this configuration, water less likely enters the system 60 via the exhaust valve 26. Furthermore, this configuration lowers the exhaust resistance to better operate the exhaust valve 26 and reduces the likelihood of a free flow of gas exiting the system 60, which, otherwise, would cause a, siphoning effect of the water about the exterior of the exhaust valve 26.

Figure 5:
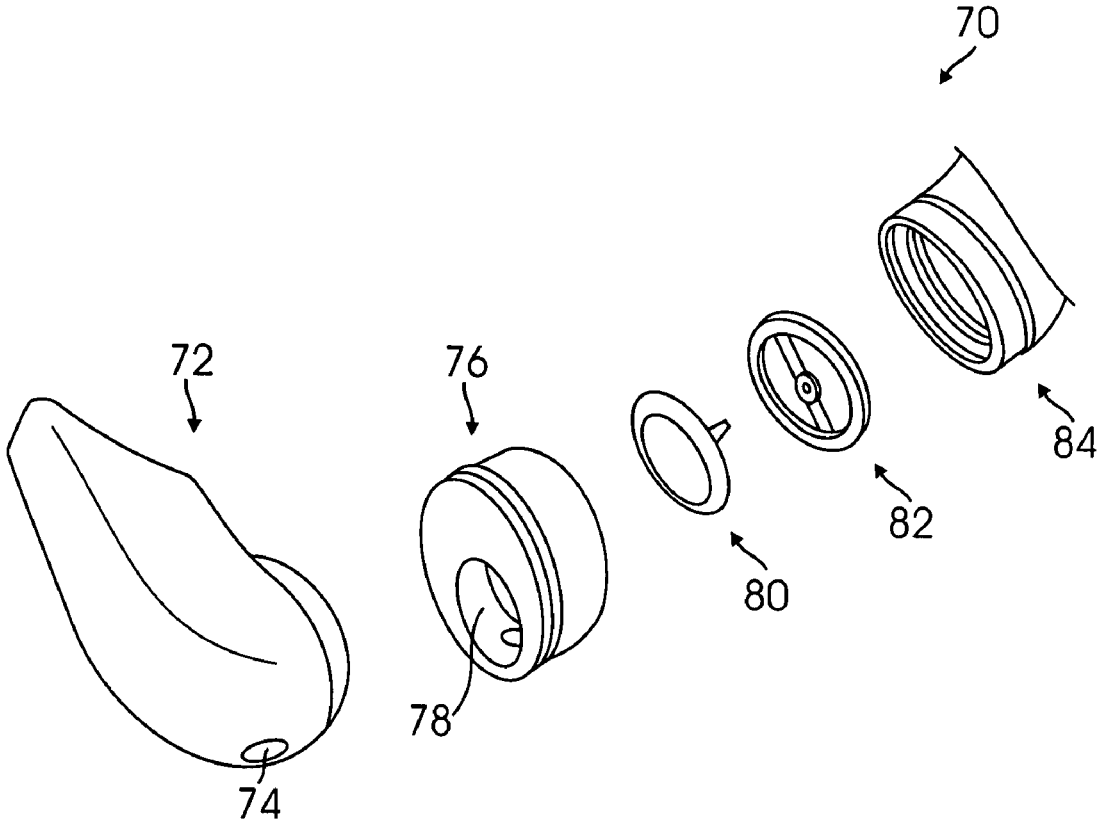
FIG. 5 is an exploded view of an underwater exhaust system according to another exemplary embodiment of the present invention.

FIG. 5 shows a perspective view of a gas exhaust system 70 for a SCUBA apparatus, in accordance with an exemplary embodiment of the present invention. The system 70 includes a bubble deflector 72, wherein the bubble deflector 72 includes a water inlet 74, and wherein the water inlet 74 allows water to enter the bubble deflector 72 for allowing the system 70 to function properly. The bubble deflector 72 includes a hood (not shown) as shown in the previously disclosed embodiment, such that a gas pocket 44 is formed to facilitate the above-described advantage. The system 70 also includes a valve cover 76, wherein the valve cover 76 includes an exhaust gas exit opening 78. In this embodiment, the system 70 also includes a circular rubber exhaust valve 80, wherein the circular rubber exhaust valve 80 couples with an exhaust valve seat 82, and wherein valve seat 82 facilitates the mounting and coupling of the system to the regulator 84. This configuration is one embodiment of present invention systems, herein described, wherein the location and orientation of an exhaust gas exit opening 78 and a water inlet 74 is shown in a space relation with the remaining components of the system 70, by example only.

Figure 6:
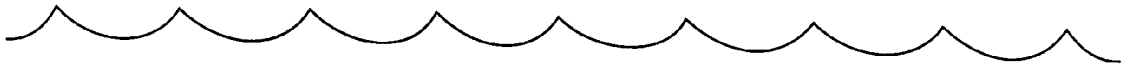
FIG. 6 is a plan view of an underwater exhaust system according to another exemplary embodiment of the present invention.
Figure 6:
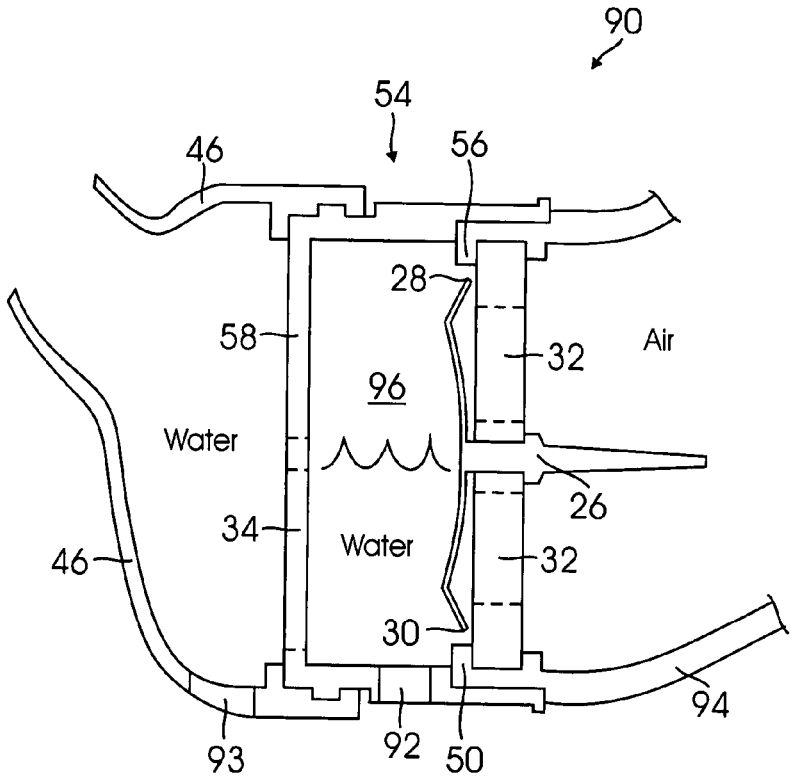

FIG. 6 shows an exhaust system 90 for a SCUBA apparatus, in accordance with another embodiment of the present invention. The system 90 includes a regulator housing 94, an exhaust valve 26, and an exhaust outlet 32. Again, in this embodiment, a circular exhaust valve 26 includes an upper sealing edge 28 and a lower sealing edge 30. The system 90 includes a valve cover 54, wherein the valve cover 54 includes water inlets 92, 93 to allow water to enter the valve cover 54. As gas exits the system 90, flow of water from the water inlets 92, 93 creates a pocket 96 that, again, reduces the likelihood of a free flow condition of gas exiting the system 90, and redirects the flow of water about the exterior of the exhaust valve 26. The redirection of water also reduces the likelihood that water will enter the system 90, via the sealing edges 28, 30 of the exhaust valve 26, and reduces the likelihood of gas free flowing from the system 90.

The system 90 includes a bubble deflector 46 for facilitating gas exiting the system 90. Again, this embodiment includes a configuration that allows a gas pocket 96 to form to achieve the above-outlined objectives. Exhaust exits the system 90 via the exhaust gas exit opening 34 and out through the bubble deflector 46. The system 90 also includes the circular projections 50, 56 that may, again, decrease the likelihood that water enters the system 90 via the lower sealing edge 30 and the upper sealing edge 28 of a circular exhaust valve 26, respectively.

Figure 7:
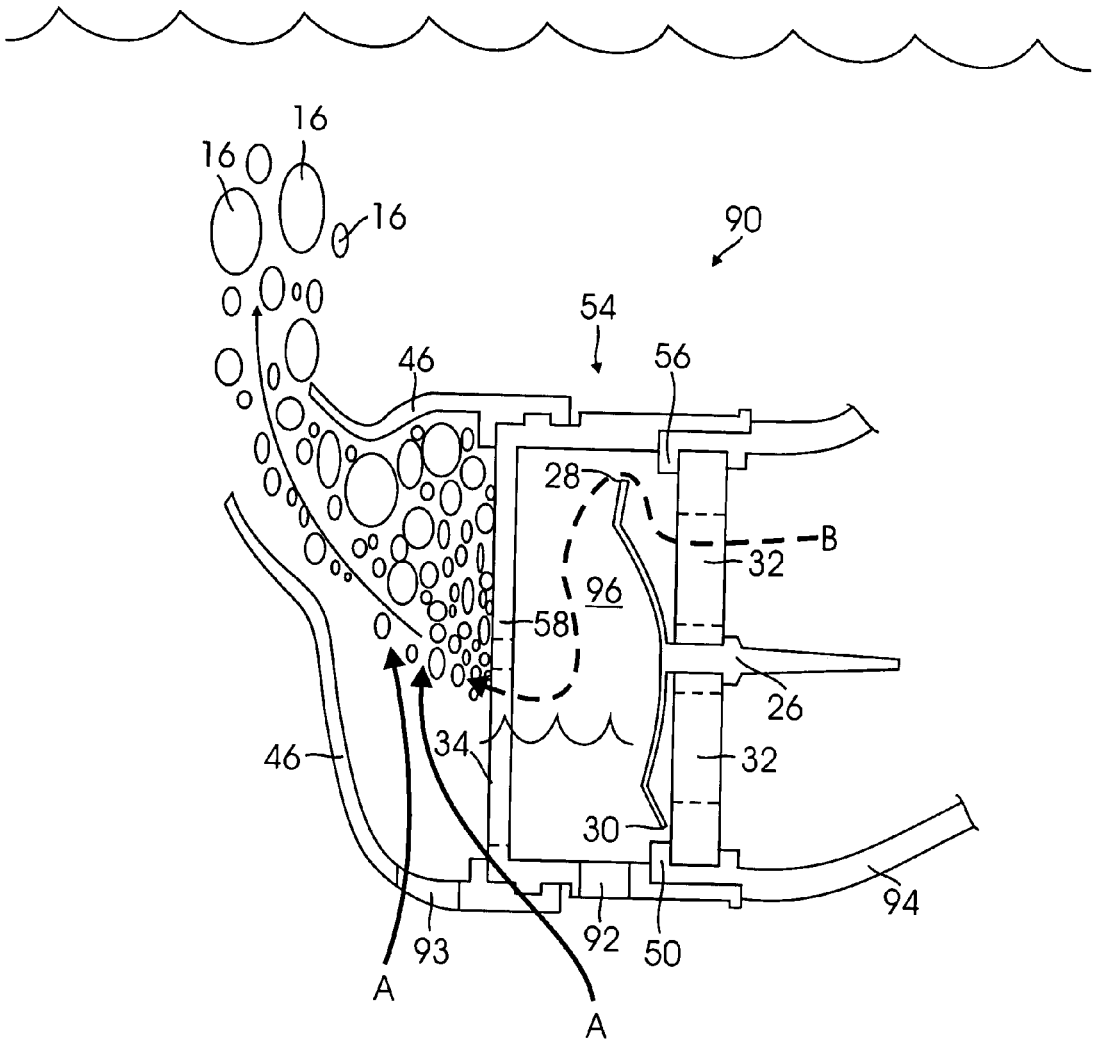
FIG. 7 is a plan view of the underwater exhaust system of the present invention, as shown in the embodiment of FIG. 6, illustrating the flow of water and exhaust air about the system.

FIG. 7 shows the gas and water flow paths in the system 90 of FIG. 6, in accordance with the present invention. The gas exits the system 90 as shown by the directional arrow B to form the pocket 96. The gas forms in the pocket 96 due to the configuration of the hood 58 and then exits the valve cover 54 via the exhaust gas opening 34.

This configuration alters the flow of water about the system 90 as shown by the directional arrow A. Water flows in the water inlets 92, 93, encounters the exhaust gas pocket 96, exits the system 90 via the exhaust gas exit opening 34, and carries the plurality of bubbles 16 from the system 90 through the bubble deflector 46. Again, this configuration equalizes the pressure between the interior region and exterior region of the exhaust gas system 90. Furthermore, this configuration decreases the likelihood that water enters the system 90 via the exhaust valve 26 and further decreases the likelihood of a siphoning effect by directing the water flow across the exhaust valve 26. This configuration also decreases the likelihood that a free flow of gas occurring upon exiting the system 90.

Figure 8:
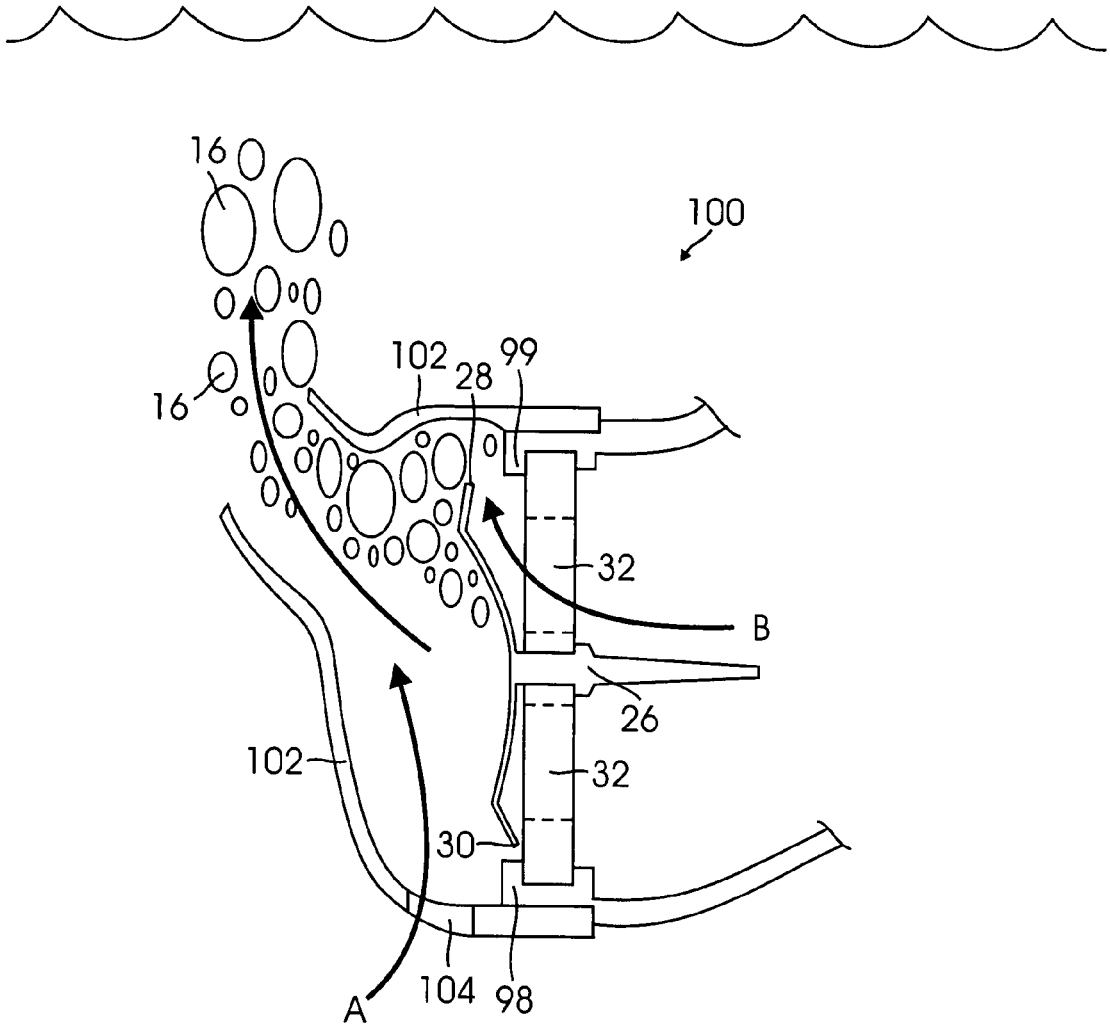
FIG. 8 is a plan view of an underwater exhaust system according to another exemplary embodiment of the present invention.

FIG. 8 shows an exhaust gas system 100 for a SCUBA apparatus, in accordance with another embodiment of the present invention. In this embodiment, the system 100 includes a circular rubber exhaust valve 26 and an exhaust gas outlet 32. Again, the exhaust valve 26 includes an upper sealing edge 28 and a lower sealing edge 30. The system 100 includes a circular projection 98 that alters the flow of water about the exterior of the exhaust valve 26, such that water less likely enters the system 100 via the lower sealing edge 30. Water enters the system 100 via the water inlet 104. The system 100 also includes a circular projection 99 that alters the water flow about the exhaust valve 26 such that water less likely enters the system 100 via upper sealing edge 28. That other configurations is utilized, such that projections are included to alter the flow of water about the exterior of the exhaust valve 26, will be appreciated as being encompassed by the scope of the present invention. Again, gas exits the system 100, as shown by the directional arrows B, and combines with the water entering the inlet hole 104 to create the laminar flow of water on the exhaust valve 26. This configuration alters the flow of water as shown by the directional arrow A with respect to the exhaust valve 26, such that a siphoning effect and a free flow of gas exiting the system 100 less likely occur. The gas then exits the system 100 as a plurality of bubbles 16 via a bubble deflector 102. That many configurations of the bubble deflector 102 are utilized, such that the bubble deflector 102 creates an exhaled air pocket or gas pocket to equalize the pressure and/or redirect the flow of water about the exhaust valve 26 to achieve the desired results, will be appreciated as being encompassed by the scope of the present invention.

The structure for directing water about an exhaust valve includes projections, hoods, and valve covers as herein disclosed. Furthermore, the structure for directing water also includes all other configurations and embodiments as herein disclosed. The structure for creating an exhaust air pocket adjacent the exhaust valve includes the hoods and valve covers herein disclosed. Furthermore, the structure for creating an exhaust air pocket adjacent the exhaust valve includes all other configurations herein disclosed. The bubble deflector comprises a hard rubber, plastic, or other materials. The exhaust valve comprises a rubber, metal, hard plastic, or other material. Other portions of the system comprise an injection-molded rubber, plastics, metals, other materials, and combinations thereof, as desired.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, that various changes and modifications in form, material, and fabrication material is made, without departing from the spirit and scope of the inventions as set forth in the appended claims, should be readily apparent to those of ordinary skill in the art. No claim herein is to be construed under the provisions of 35 U.S.C. §112, sixth paragraph, unless the element is expressly recited using the phrase "means for."

INDUSTRIAL APPLICABILITY

The present invention industrially applies to equipment for scuba diving. More particularly, the present invention industrially applies to systems for managing exhaust during scuba diving. Even more particularly, the present invention industrially applies to systems having an improved exhaust valve for managing exhaust during scuba diving.

What is claimed is:

1. An underwater exhaust system for a self-contained underwater breathing apparatus, comprising:

a housing for accommodating an air regulator in the self-contained underwater breathing apparatus, the housing comprising at least one exhaust gas outlet for exiting at least one exhaust gas;

an exhaust valve being operatively coupled with the housing, the exhaust valve comprising a valve head and a valve stem, the valve head having a water-interface side and at least one sealing edge; and at least one projection in spaced relation to the exhaust valve for directing a water flow away from the exhaust valve, wherein air from an external source entering the air regulator may be exhausted through said exhaust gas outlet, wherein the at least one sealing edge comprises an upper sealing edge and a lower sealing edge, wherein the at least one projection comprises an upper projection and a lower projection, and wherein the at least one exhaust gas exits the exhaust gas outlet between the upper sealing edge and the upper projection, whereby water is directed away from the lower sealing edge and the lower projection, whereby a siphoning effect is prevented, and whereby water ingress is prevented.

2. An underwater exhaust system for a self-contained underwater breathing apparatus, comprising a housing for accommodating an air regulator in the self-contained underwater breathing apparatus, the housing comprising at least one exhaust gas outlet for exiting at least one exhaust gas;

an exhaust valve being operatively coupled with the housing, the exhaust valve comprising a valve head and a valve stem, the valve head having a water-interface side and at least one sealing edge; and at least one projection in spaced relation to the exhaust valve for directing a water flow away from the exhaust valve, wherein air from an external source entering the air regulator may be exhausted through said exhaust gas outlet, and a valve seat for accommodating the exhaust valve, the valve seat being operatively disposed between the housing and the exhaust valve, wherein the valve head comprises a circular configuration, wherein the at least one sealing edge comprises an upper sealing edge and a lower sealing edge, wherein the at least one projection comprises an upper projection and a lower projection, wherein the at least one exhaust gas exits the exhaust gas outlet between the upper sealing edge and the upper projection, whereby water is directed away from the lower sealing edge and the lower projection, whereby a siphoning effect is prevented, and whereby water ingress is prevented, and wherein the at least one projection comprises a step configuration on the water-interface side of the exhaust valve for preventing water ingress between the at least one sealing edge and the valve seat.

3. A method of reducing the likelihood of water ingress by way of an underwater exhaust system for a self-contained underwater breathing apparatus, the method comprising the steps of:

providing an underwater exhaust system for the self-contained underwater breathing apparatus, including an exhaust valve; and directing a water flow away from the exhaust valve, wherein the underwater exhaust system for a self-contained underwater breathing apparatus providing step comprises:

providing a housing for accommodating an air regulator in the self-contained underwater breathing apparatus, the housing providing step comprising providing at least one exhaust gas outlet for exiting at least one exhaust gas;

providing an exhaust valve being operatively coupled with the housing, the exhaust valve providing step comprising providing a valve head and providing a valve stem, the valve head providing step comprising providing a water-interface side and providing at least one sealing edge; and providing at least one projection in spaced relation to the exhaust valve for directing a water flow away from the exhaust valve, wherein air from an external source entering the air regulator may be exhausted through said exhaust gas outlet, wherein the at least one sealing edge comprises an upper sealing edge and a lower sealing edge, wherein the at least one projection comprises an upper projection and a lower projection, and wherein the at least one exhaust gas exits the exhaust gas outlet between the upper sealing edge and the upper projection, whereby water is directed away from the lower sealing edge and the lower projection, whereby a siphoning effect is prevented, and whereby water ingress is prevented.

4. A method of reducing the likelihood of water ingress by way of an underwater exhaust system for a self-contained underwater breathing apparatus, the method comprising the steps of:

providing an underwater exhaust system for the self-contained underwater breathing apparatus, including an exhaust valve; and directing a water flow away from the exhaust valve, wherein the valve head providing step comprises providing a circular configuration, wherein the at least one sealing edge providing step comprises providing an upper sealing edge and a lower sealing edge, wherein the at least one projection providing step comprises providing an upper projection and a lower projection, wherein the at least one exhaust gas exits the exhaust gas outlet between the upper sealing edge and the upper projection, whereby water is directed away from the lower sealing edge and the lower projection, whereby a siphoning effect is prevented, and whereby water ingress is prevented, wherein the at least one projection providing step comprises providing a step configuration on the water-interface side of the exhaust valve for preventing water ingress between the at least one sealing edge and the valve seat, wherein the directing step comprises allowing a plurality of gas bubbles to form adjacent the exhaust valve, and wherein the directing step comprises directing the water flow away from the at least one sealing edge of said exhaust valve using the at least one projection.

* * * * *